US008926483B1

(12) United States Patent
Holloway

(10) Patent No.: US 8,926,483 B1
(45) Date of Patent: Jan. 6, 2015

(54) INTERCHANGEABLE BALANCE DOME COVER APPARATUS

(71) Applicant: Jennifer J. Holloway, Clearwater, FL (US)

(72) Inventor: Jennifer J. Holloway, Clearwater, FL (US)

( * ) Notice: Subject to any disclaimer, the term of this patent is extended or adjusted under 35 U.S.C. 154(b) by 0 days.

(21) Appl. No.: 14/467,448

(22) Filed: Aug. 25, 2014

(51) Int. Cl.
*A63B 26/00* (2006.01)

(52) U.S. Cl.
CPC ..... *A61B 26/003* (2013.01)
USPC .... 482/142; 482/140; 297/271.5; 297/452.51

(58) Field of Classification Search
USPC ..... 482/140–142, 148, 51, 121, 91; 297/271.5, 452.41; 446/220
See application file for complete search history.

(56) References Cited

U.S. PATENT DOCUMENTS

| | | | | | |
|---|---|---|---|---|---|
| 4,475,768 | A | * | 10/1984 | Webb | 297/283.1 |
| 4,718,721 | A | | 1/1988 | Pompa | |
| 5,338,095 | A | * | 8/1994 | Laughlin et al. | 297/440.1 |
| 5,690,389 | A | | 11/1997 | Ekman et al. | |
| 5,738,414 | A | * | 4/1998 | Wieland et al. | 297/440.1 |
| 6,390,559 | B1 | | 5/2002 | Schnitzhofer | |
| 6,409,264 | B1 | | 6/2002 | Palmer et al. | |
| 6,702,726 | B2 | | 3/2004 | Lin | |
| 6,832,817 | B1 | | 12/2004 | Chiu | |
| 6,945,919 | B2 | | 9/2005 | Yang | |
| 7,341,548 | B2 | | 3/2008 | Heitzman et al. | |
| 7,494,446 | B2 | | 2/2009 | Weck et al. | |
| 8,056,976 | B1 | | 11/2011 | Polk | |
| 2007/0155601 | A1 | | 7/2007 | Dykgraaf et al. | |
| 2013/0017937 | A1 | | 1/2013 | Guarrasi | |

* cited by examiner

*Primary Examiner* — Stephen Crow
(74) *Attorney, Agent, or Firm* — Anton J. Hopen; Smith & Hopen, P.A.

(57) ABSTRACT

An interchangeable cover is secured between a lower base and an upper cover retention body over an inflatable dome. The entire assembly is placed on a chair for an individual to sit on for stability core training. The upper cover retention body and lower base detach from compressive engagement of the interchangeable cover to replace the cover as desired by the individual.

14 Claims, 8 Drawing Sheets

INTERCHANGEABLE BALANCE DOME COVER APPARATUS

BACKGROUND OF THE INVENTION

1. Field of the Invention

This invention relates to exercise equipment. More specifically, it relates to an apparatus to interchange aesthetically-pleasing covers over balance domes used for core training.

2. Brief Description of the Related Art

Balance domes are inflatable, stationary exercise devices. They are inflated to a pressure whereby sitting, standing, kneeling, pushing or otherwise engaging the dome compresses the inner plenum and deforms the dome's shape. As the dome deforms, the person engaging the dome must shift his or her center of balance in response.

A primary benefit of exercising with a stability dome as opposed to exercising directly on a hard flat surface is that the body responds to the instability of the dome to remain balanced, engaging many more muscles. Those muscles become stronger over time to keep balance. Most frequently, the core body muscles, the abdominal muscles and back muscles, are the focus of balance dome exercising.

Balance domes have found their way into the workplace with individuals sometimes sitting on spherical stability balls instead of regular chairs. However, for a variety of reasons, both practical and aesthetic, many individuals forgo the use of stability balls.

Another option for individuals is to use a balance dome placed upon a chair. While the movement is more confined than that of a stability ball there is still more development of core muscles than in sitting in a chair without the dome. However, one drawback to this option is the aesthetics of the dome itself. Most domes are manufactured with the anticipation they will be used in a gym environment. Therefore, the colors are typically bright pastels which are not suitable or pleasing in a work or home environment.

One possible option is to provide covers for the otherwise unattractive appearance of the balance dome. It is known in the art to manufacture zip-on covers for spherical, stability balls. However, sewing a cover for a ball (or a dome for that matter) is generally a complicated process involving fabrication of darts, pleats or gores to shape the sphere or half-sphere. For individuals that want to tailor the aesthetic appearance of their balance dome to the surrounding décor, the work involved is substantial.

What is needed in the art is an apparatus to easily interchange covers over a balance dome without requiring sophisticated sewing and patterning. However, in view of the art considered as a whole at the time the present invention was made, it was not obvious to those of ordinary skill in the field of this invention how the shortcomings of the prior art could be overcome.

BRIEF SUMMARY OF THE INVENTION

The novel structure for interchanging balance dome covers includes a substantially rigid base for supporting the lower, planer surface of an inflatable balance dome. The base may be constructed of wood, metal, hard plastic or the like. For balance domes intended to be placed on chairs, it is preferred that the rigid base be substantially rectangular in shape having length/width dimensions between 12 and 24 inches. A rectangular base helps secure the dome on the chair seat so that the instability of the apparatus is limited to the deformity resulting from sitting on the dome by the user.

The dome's base lays on top of the rigid base. The dome's base is a lower, planer surface having a first diameter (the largest diameter of the dome). The interior of the inflatable dome is defined by interstitial space forming a plenum of sufficient pressure to bear the weight of a human sitting on it with some deformity occurring in the inflatable balance dome due to compression of the plenum. Across a population of humans there is a substantial variability of weight. Therefore, the pressure (plenum) inside the dome may be adjusted to accommodate heavier and lighter individuals.

Over the inflatable dome is placed a dome cover intended to be primarily aesthetic. However, the present invention anticipates that dome covers may be constructed with tactical surface features having therapeutic and/or physiologic use. The dome cover has an annular, lower flange about its circumference of a second diameter, the second diameter greater than the first diameter of the base of the inflatable dome. This flange provides a surface in which to "lock" the cover in place over the dome.

A cover retention body mates with the rigid base sandwiching the lower flange of the dome cover in between. The retention body has an outer perimeter substantially the same as the rigid base. The cover retention body has an annular opening of approximately the first diameter though which the inflatable dome and cover project.

A retention mechanism secures the cover retention body, dome cover and inflatable balance dome to the rigid base whereby the annular, lower flange of the dome cover is compressively sandwiched between the retention body and the rigid base. At least one hinge pivotably couples the cover retention body to the rigid base on a first end of the base wherein a locking mechanism is positioned at a second end of the apparatus distal to the first end. Upon disengagement of the locking mechanism the rigid base-cover retention body assembly pivots open about the axis of the hinge to release the dome cover lower flange from compressive engagement.

In an alternative embodiment of the invention, at least two screw interfaces but preferably four equidistantly spaced proximate to each corner of the rectangular base threadably receive screws which compressively sandwich the dome cover lower flange between the cover retention body and the rigid base.

In yet another alternative embodiment of the invention, at least two openings in the upper surface of the rigid base are provided. Each opening has a first aperture and a second smaller aperture in open communication with the first aperture. An interstitial space underneath the second smaller aperture is of greater or equal width of the first aperture. Each opening receives a downwardly projecting pin affixed to the lower surface of the retention body, each pin having an annular head with a diameter less than the first aperture of the correspondingly aligned opening in the upper surface of the rigid base but greater than the second smaller aperture. Each projecting pin head on the lower surface of the retention body is aligned to be received initially by a first aperture and then slideably received by the interstitial space underneath the second smaller aperture. The diameter of the pin between the pin head and the lower surface of the retention body is less than or equal to the second smaller diameter aperture. In an embodiment of the invention, the pin and smaller diameter aperture form an interference fit.

In yet another alternative embodiment of the invention, the at least two openings may be formed in the lower surface of the invention body and the pins project upward from the upper surface of the rigid base.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
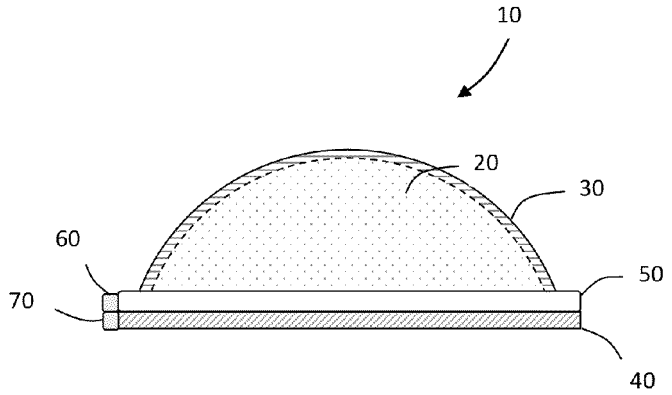
FIG. 1 is a partially sectional, side elevation view of an embodiment of the invention.
Figure 2:
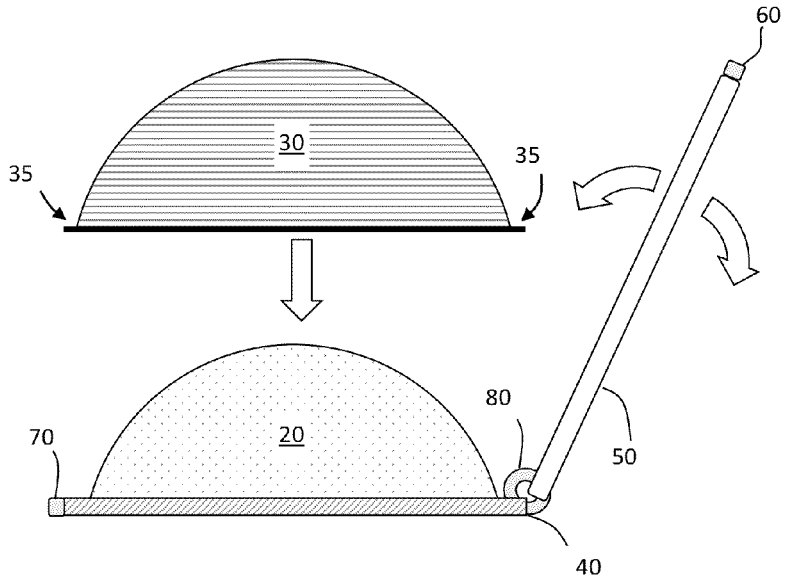
FIG. 2 is an exploded, side elevation view of an embodiment of the invention.

The novel structure is denoted as a whole in FIG. 1 by the reference numeral 10. Inflatable balance (or stability) dome 20 is pressurized with air. Dome cover is received over balance dome 20 and is secured by substantially rigid base 40 and cover retention body 50. In FIG. 2, an exploded view of the assembly is shown. Cover 30 has an annular, lower flange 35 which provides a surface area upon which cover retention body 50 and rigid base 40 sandwich with compressive force and secured by upper and lower locks 60 and 70 respectively.

Figure 3:
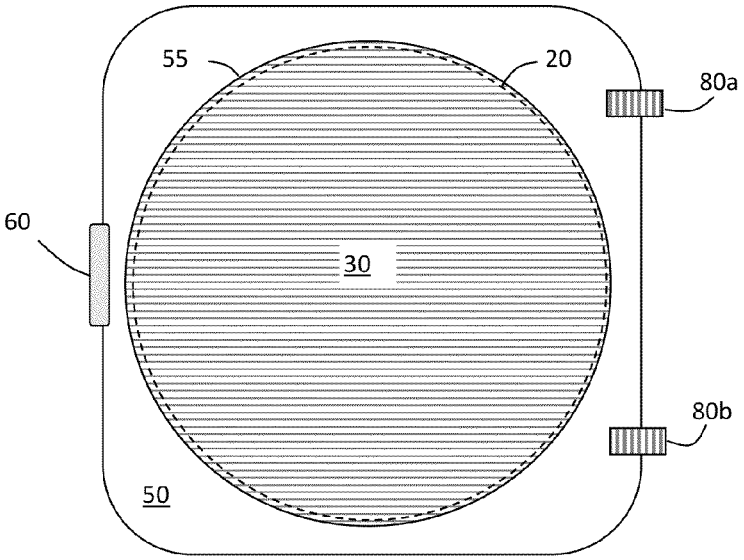
FIG. 3 is a partially sectional, top down view of an embodiment of the invention.
Figure 4:
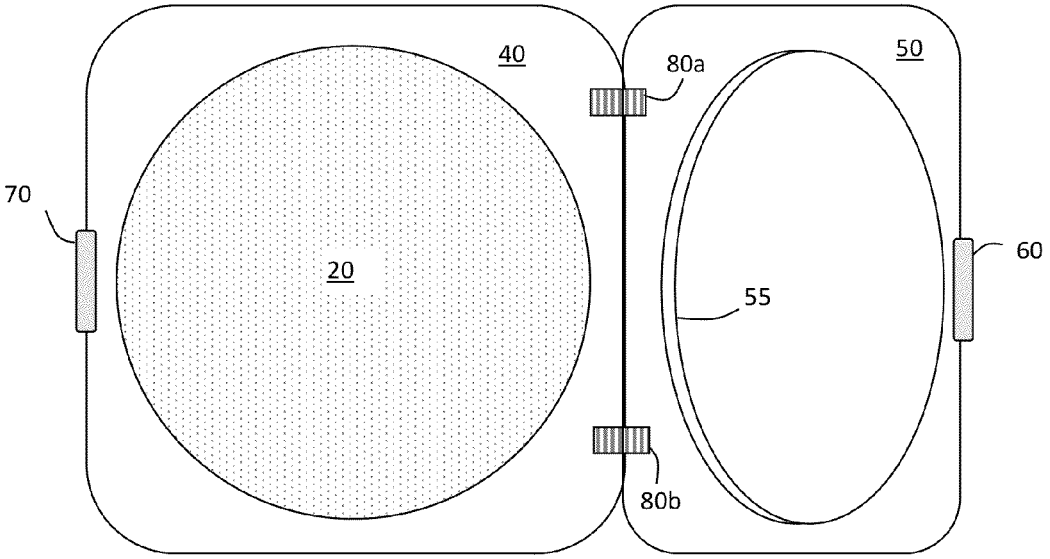
FIG. 4 is a top down view of an embodiment of the invention.

In an embodiment of the invention, cover retention body 50 and rigid base 40 pivot about an axis defined by hinge 80. FIG. 3 shows a top down view of an embodiment of the invention having hinges 80*a-b*. Cover retention body 50 has a large circular opening 55 in which balance dome 20 and cover 30 project. FIG. 4 shows the same embodiment wherein upper lock 60 and lower lock 70 are disengaged and cover retention body 50 is pivoted to an open state with cover 30 removed.

Figure 5:
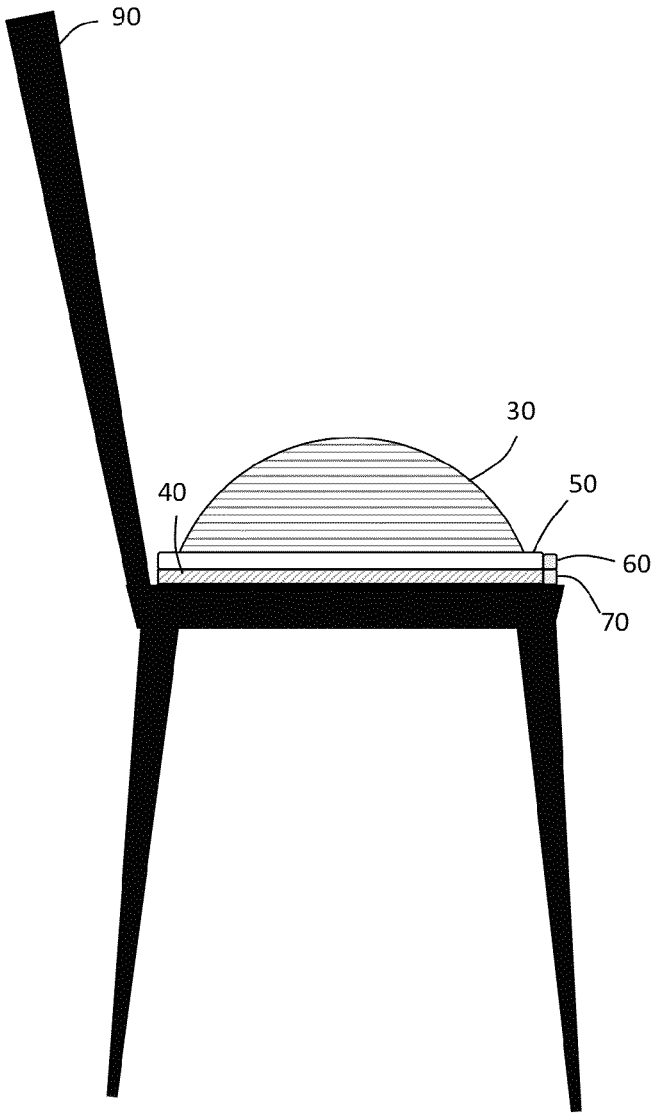
FIG. 5 is a side elevation view of an embodiment of the invention on a chair seat.

FIG. 5 shows the embodiment in one intended use on the seat of chair 90. As an individual sits on the apparatus, the dome compresses and deforms causing the individual to frequently shift his or her weight. This shifting of weight exercises the muscles of the abdomen and back.

Figure 6:
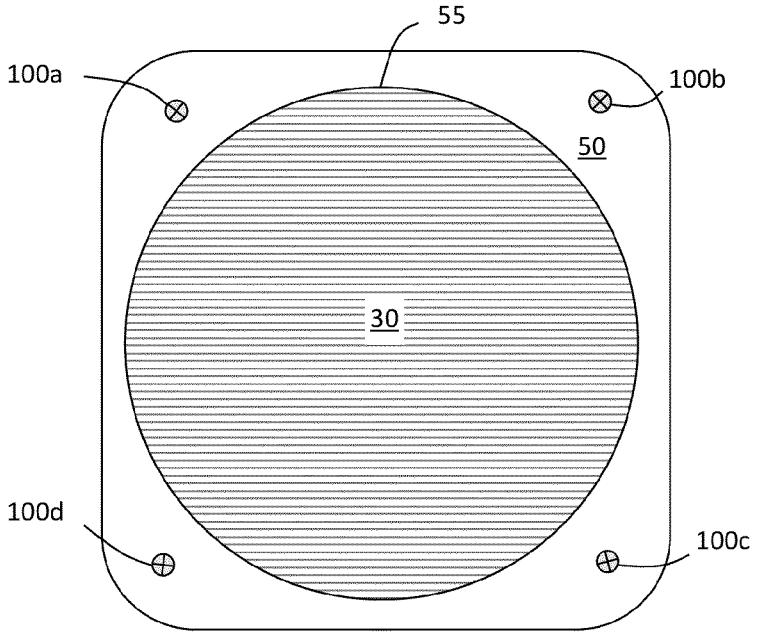
FIG. 6 is a top down view of an embodiment of the invention.
Figure 7:
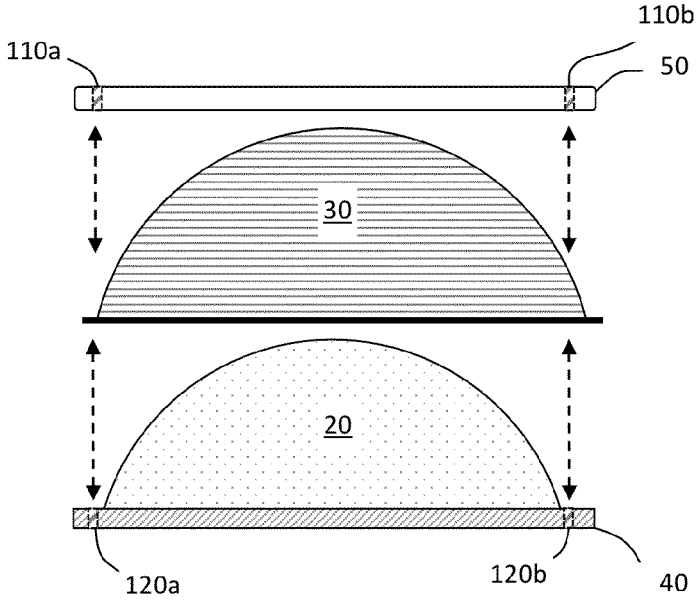
FIG. 7 is a partially sectional, exploded side elevation view of an embodiment of the invention.

FIGS. 6-7 show an alternative embodiment of the invention. Instead of using hinge 80, four screw engagements 100*a-d* lock down cover retention body 50 to rigid base 40. Threaded apertures 110*a-b* in retention body 50 align with corresponding threaded apertures 120*a-b* in rigid base.

Figure 8:
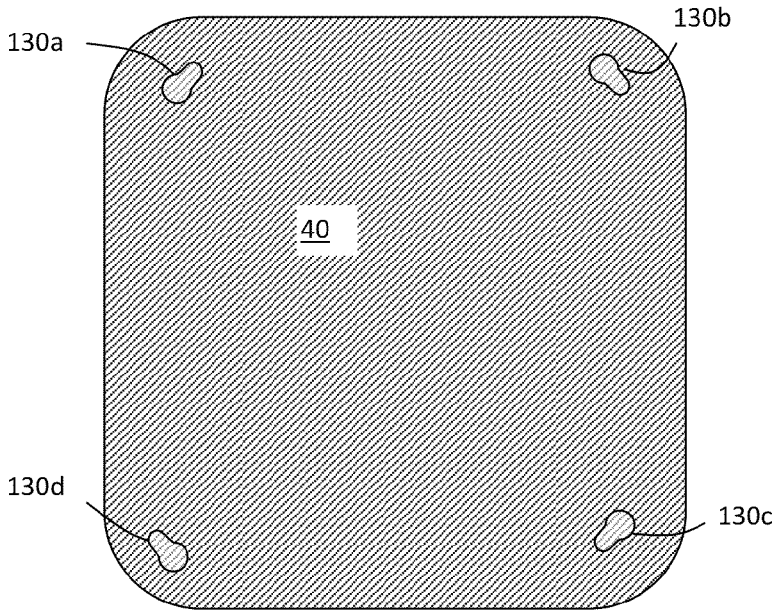
FIG. 8 is a top down view of an embodiment of the invention.
Figure 9:
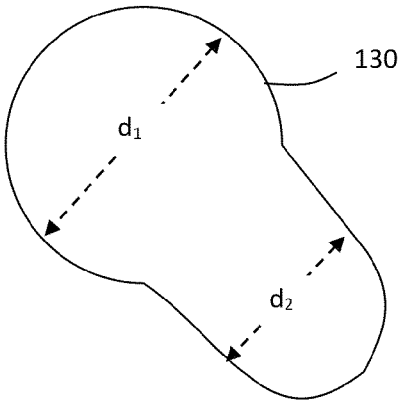
FIG. 9 is a close-up view of an opening used in FIG. 8.

FIGS. 8-12 show an alternative embodiment of the invention wherein the retention body 50 and rigid base 40 twist upon a center axis to engage and disengage the cover. FIG. 8 shows the rigid base 40 having openings 130*a-d* in its upper surface. Each opening 130 has a first aperture of diameter $d_1$ and a second aperture of diameter $d_2$ wherein $d_2$ is less than $d_1$ as shown in FIG. 9. Pins 140*a-b* (FIG. 12) project downwardly from retention body 50. Each pin 140 has an annular head with a diameter less than that of the first aperture in opening 130. Under second aperture in opening 130 is an interstitial space of greater or equal width of the first aperture and design to laterally receive annular head of pin 140.

Figure 10:
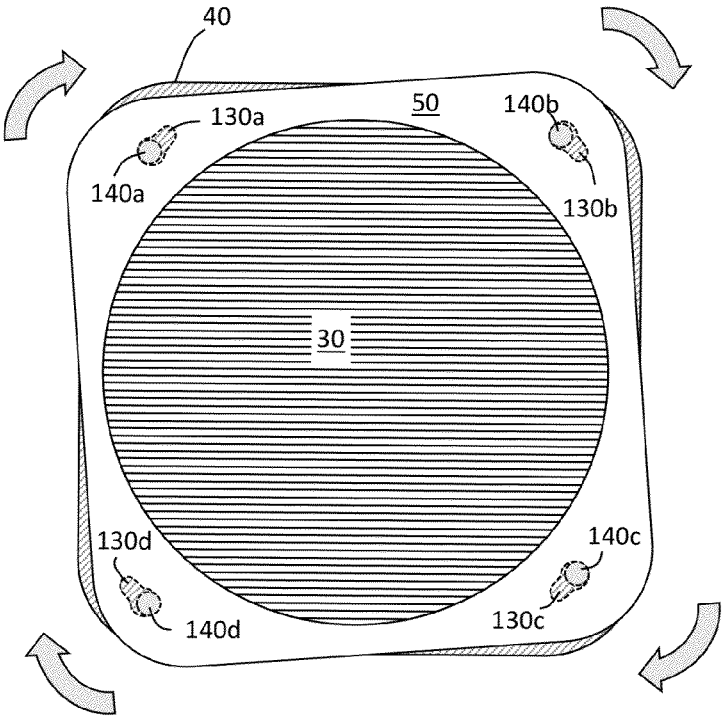
FIG. 10 is a top down view of an embodiment of the invention.
Figure 11:
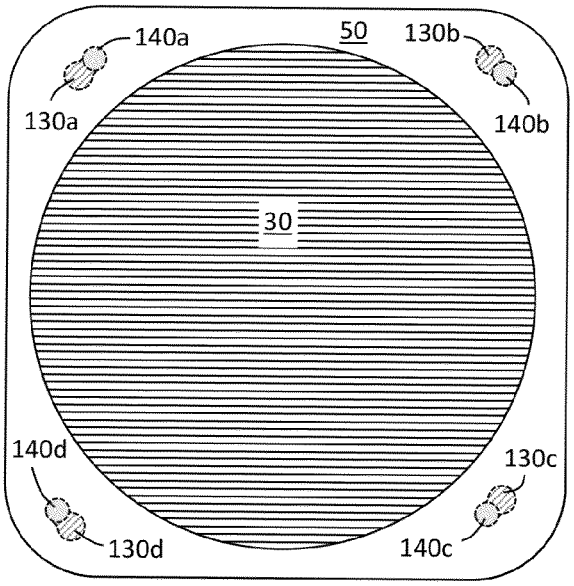
FIG. 11 is a top down view of an embodiment of the invention.
Figure 12:
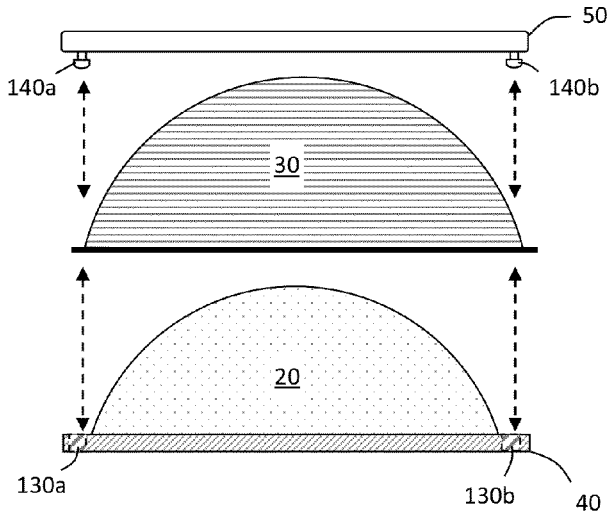
FIG. 12 is a partially sectional, exploded side elevation view of an embodiment of the invention.

As shown in FIG. 10, pins 140*a-d* align with first aperture of openings 130*a-d*. The annular head of each pin is small enough to be received with first aperture but not by second aperture. Once pins 140*a-d* are inserted, retention body 50 is rotated clockwise with respect to rigid base 40 which causes pins 140*a-d* to slide into second aperture of opening 130. Annular head of each pin locks into the interstitial space underneath second aperture. As annular head's diameter is larger than that of second aperture, rigid base 40 and retention body 50 are locked in place thereby securing cover 30 over dome 20.

Figure 13:
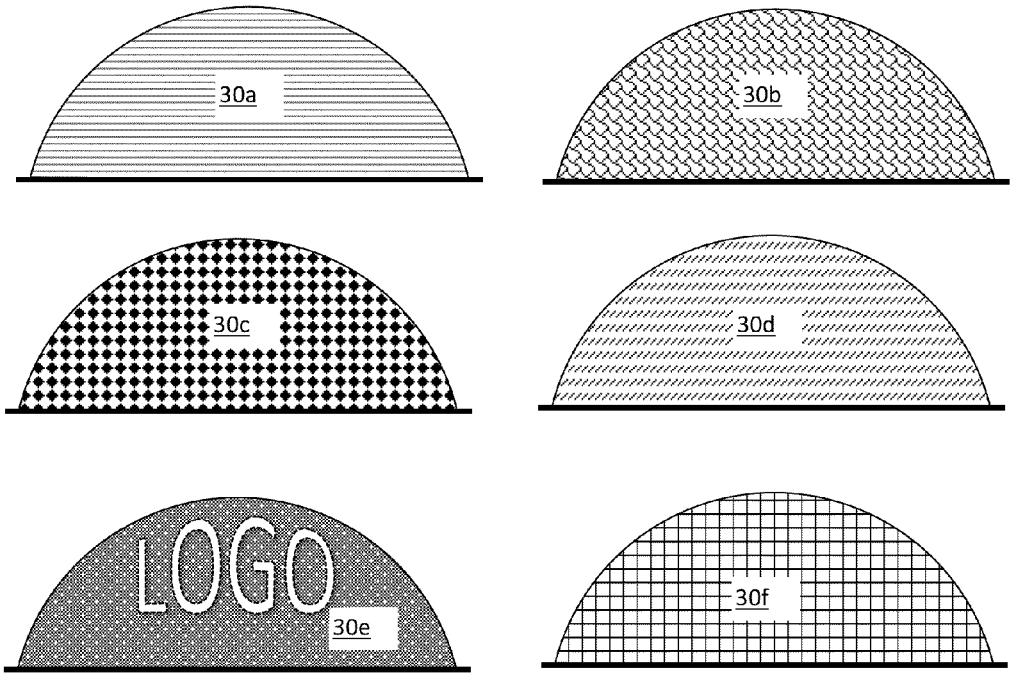
FIG. 13 shows side elevation views of a plurality of dome covers according to the invention.

FIG. 13 is an illustrative side elevation view of variations to cover 30*a-f* which are easily interchanged over dome according to the invention.

Figure 14:
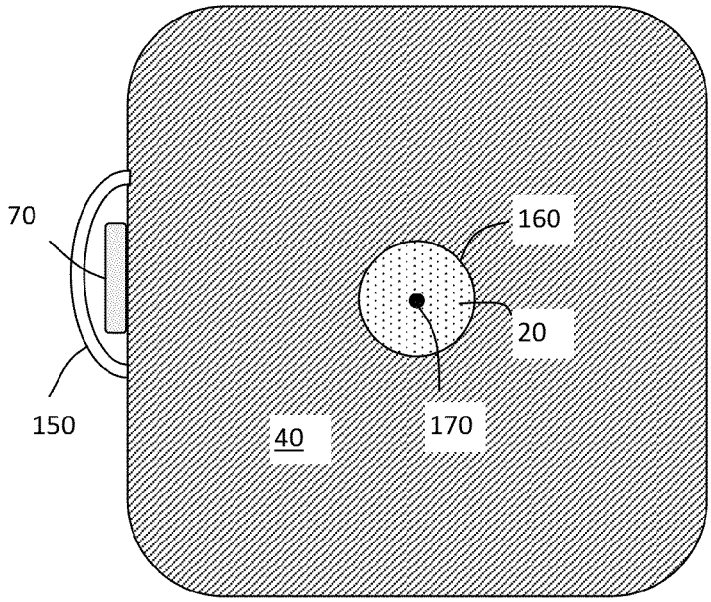
FIG. 14 is a bottom-up view of rigid base according to an embodiment of the invention.
Figure 15:
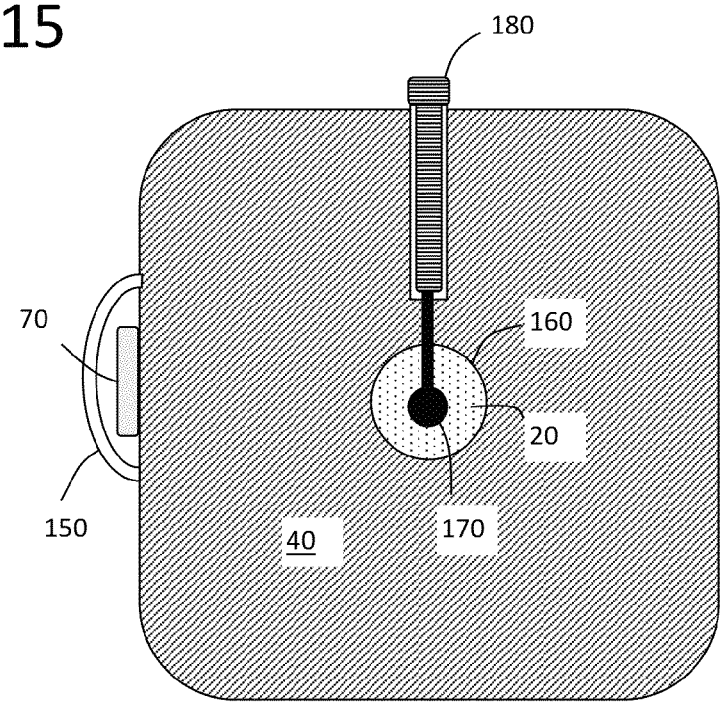
FIG. 15 is a bottom-up view of rigid base according to an embodiment of the invention.

FIG. 14 is an alternative embodiment of the invention that provides carrying handle 150 affixed to rigid base 40. In addition, inflatable dome 20 has inflation valve 170 located in the center axis of the dome shape at the bottom portion of the inflatable dome 20. To provide access to the inflation valve 170 while the retention body 50 and rigid base 40 are locked together an access opening 160 is provided in rigid base 40.

In yet another alternative embodiment of the invention, air pump 180 is integral to rigid base 40 and in fluid communication with inflation valve 170. This way an individual may adjust the pressure of the inflatable dome 20 to provide the desired level of stability (or instability) based on the plenum pressure within inflatable dome 20.

GLOSSARY OF CLAIM TERMS

Rigid Base: means a substantially planer surface upon which the inflatable dome rests. The base may be of any predetermined geometric configuration but has a perimeter substantially the same as cover retention body.

Cover Retention Body: means a substantially planer surface having a circular opening through which the inflatable dome and cover assembly are received. The cover retention body compresses an outer flange of material of the cover against the rigid base to hold the cover in place.

Retention Mechanism: means a latch, screw, lock or other mechanical means to hold to the rigid base against the cover retention body thereby locking the cover between them.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An apparatus for interchanging balance dome covers, the apparatus comprising:

a substantially rigid base for supporting the lower, planer surface of an inflatable balance dome, the lower, planer surface of the inflatable balance dome having a first diameter, the interior of the inflatable balance dome defined by interstitial space forming a plenum of sufficient pressure to bear the weight of a human sitting on it with some deformity occurring in the inflatable balance dome due to compression of the plenum;

a dome cover received over the inflatable balance dome, the dome cover having an annular, lower flange about its circumference of a second diameter, the second diameter greater than the first diameter;

a cover retention body, the retention body having an outer perimeter substantially the same as the rigid base, the cover retention body further having an annular opening of approximately the first diameter; and a retention mechanism to secure the cover retention body, dome cover and inflatable balance dome to the rigid base whereby the annular, lower flange of the dome cover is compressively sandwiched between the retention body and the rigid base.

2. The apparatus of claim 1, further comprising at least one hinge pivotably coupling the cover retention body to the rigid base on a first end of the rigid base wherein the retention mechanism is positioned at a second end of the apparatus distal to the first end whereby upon disengagement of the retention mechanism the rigid base-cover retention body assembly pivots open about the axis of the hinge to release the dome cover lower flange from compressive engagement.

3. The apparatus of claim 1, further comprising at least two screws threaded between the cover retention body and the rigid base wherein engagement of the screws sandwich the dome cover lower flange compressively.

4. The apparatus of claim 1, further comprising:

at least two openings in the upper surface of the rigid base, each opening having a first aperture and a second smaller aperture in open communication with the first aperture;

an interstitial space underneath the second smaller aperture, the interstitial space of greater or equal width of the first aperture; and at least two downwardly projecting pins on the lower surface of the retention body, each pin having an annular head with a diameter less than the first aperture but greater than the second smaller aperture of each opening in the upper surface of the rigid base, each projecting pin head aligned to be received by the first aperture and then slideably received by the interstitial space underneath the second smaller aperture, the diameter of the pin between the pin head and the lower surface of the retention body less than or equal to the second smaller diameter aperture.

5. The apparatus of claim 1, further comprising:

at least two openings in the lower surface of the retention body, each opening having a first aperture and a second smaller aperture in open communication with the first aperture;

an interstitial space underneath the second smaller aperture, the interstitial space of greater or equal width of the first aperture; and at least two downwardly projecting pins on the upper surface of the rigid base, each pin having an annular head with a diameter less than the first aperture but greater than the second smaller aperture of each opening in the lower surface of the retention body, each projecting pin head aligned to be received by the first aperture and then slideably received by the interstitial space underneath the second smaller aperture, the diameter of the pin between the pin head and the upper surface of the rigid base less than or equal to the second smaller diameter aperture.

6. The apparatus of claim 1 further comprising an access opening in the rigid base thereby permitting access to an inflation valve located at the bottom of inflatable balance dome.

7. The apparatus of claim 1 further comprising an air pump integral to rigid base and in fluid communication with an inflation valve located at the bottom of inflatable balance dome.

8. An apparatus for interchanging balance dome covers, the apparatus comprising:

a substantially, rectangular rigid base between 12-24 inches in width and length for supporting the lower, planer surface of an inflatable balance dome, the lower, planer surface of the inflatable balance dome having a first diameter, the interior of the inflatable balance dome defined by interstitial space forming a plenum of sufficient pressure to bear the weight of a human sitting on it with some deformity occurring in the inflatable balance dome due to compression of the plenum;

a dome cover received over the inflatable balance dome, the dome cover having an annular, lower flange about its circumference of a second diameter, the second diameter greater than the first diameter;

a cover retention body, the retention body having an outer perimeter substantially the same as the rigid base, the cover retention body further having an annular opening of approximately the first diameter; and a retention mechanism to secure the cover retention body, dome cover and inflatable balance dome to the rigid base whereby the annular, lower flange of the dome cover is compressively sandwiched between the retention body and the rigid base.

9. The apparatus of claim 8, further comprising at least one hinge pivotably coupling the cover retention body to the rigid base on a first end of the rigid base wherein a locking mechanism is positioned at a second end of the apparatus distal to the first end whereby upon disengagement of the locking mechanism the rigid base-cover retention body assembly pivots open about the axis of the hinge to release the dome cover lower flange from compressive engagement.

10. The apparatus of claim 8, further comprising at least two screws threaded between the cover retention body and the rigid base wherein engagement of the screws sandwich the dome cover lower flange compressively.

11. The apparatus of claim 8, further comprising:

at least two openings in the upper surface of the rigid base, each opening having a first aperture and a second smaller aperture in open communication with the first aperture;

an interstitial space underneath the second smaller aperture, the interstitial space of greater or equal width of the first aperture; and at least two downwardly projecting pins on the lower surface of the retention body, each pin having an annular head with a diameter less than the first aperture but greater than the second smaller aperture of each opening in the upper surface of the rigid base, each projecting pin head aligned to be received by the first aperture and then slideably received by the interstitial space underneath the second smaller aperture, the diameter of the pin between the pin head and the lower surface of the retention body less than or equal to the second smaller diameter aperture.

12. The apparatus of claim 8, further comprising:

at least two openings in the lower surface of the retention body, each opening having a first aperture and a second smaller aperture in open communication with the first aperture;

an interstitial space underneath the second smaller aperture, the interstitial space of greater or equal width of the first aperture; and at least two downwardly projecting pins on the upper surface of the rigid base, each pin having an annular head with a diameter less than the first aperture but greater than the second smaller aperture of each opening in the lower surface of the retention body, each projecting pin head aligned to be received by the first aperture and then slideably received by the interstitial space underneath the second smaller aperture, the diameter of the pin between the pin head and the upper surface of the rigid base less than or equal to the second smaller diameter aperture.

13. The apparatus of claim 8 further comprising an access opening in the rigid base thereby permitting access to an inflation valve located at the bottom of inflatable balance dome.

14. The apparatus of claim 8 further comprising an air pump integral to rigid base and in fluid communication with an inflation valve located at the bottom of inflatable balance dome.

* * * * *